US005720872A

United States Patent [19]

Gupta

[11] Patent Number: 5,720,872

[45] Date of Patent: *Feb. 24, 1998

[54] MULTI-STAGE HYDROPROCESSING WITH MULTI-STAGE STRIPPING IN A SINGLE STRIPPER VESSEL

[75] Inventor: Ramesh Gupta, Berkeley Heights, N.J.

[73] Assignee: Exxon Research and Engineering Company, Florham Park, N.J.

[ * ] Notice: The term of this patent shall not extend beyond the expiration date of Pat. No. 5,705,052.

[21] Appl. No.: 775,638

[22] Filed: Dec. 31, 1996

[51] Int. Cl.[6] ..... C10G 51/02

[52] U.S. Cl. ..... 208/57; 208/58; 208/210; 208/254 H; 95/232; 95/235

[58] Field of Search ..... 95/232, 235; 208/57, 208/58, 59, 62, 63, 64, 66, 210, 251 H, 254 H

[56] References Cited

U.S. PATENT DOCUMENTS

| | | | |
|---|---|---|---|
| 4,180,453 | 12/1979 | Franck | 208/57 |
| 4,251,347 | 2/1981 | Rausch | 208/57 |
| 4,619,757 | 10/1986 | Zimmerman | 208/57 |
| 5,183,556 | 2/1993 | Reilly | 208/57 |
| 5,294,327 | 3/1994 | Everett | 208/57 |
| 5,582,711 | 12/1996 | Ellis | 208/57 |

FOREIGN PATENT DOCUMENTS

| | | | |
|---|---|---|---|
| 553920 | 8/1993 | European Pat. Off. | 208/57 |

*Primary Examiner*—Ernest G. Therkorn
*Attorney, Agent, or Firm*—Henry E. Naylor

[57] ABSTRACT

A process for hydroprocessing liquid petroleum and chemical streams in two or more hydroprocessing stages, which stages are in separate reaction vessels and wherein each reaction stage contains a bed of hydroprocessing catalyst. The liquid product from the first reaction stage is sent to a stripping stage and stripped of $H_2S$, $NH_3$ and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

16 Claims, 2 Drawing Sheets

MULTI-STAGE HYDROPROCESSING WITH MULTI-STAGE STRIPPING IN A SINGLE STRIPPER VESSEL

FIELD OF THE INVENTION

The present invention relates to a process for hydroprocessing liquid petroleum and chemical streams in two or more hydroprocessing stages, which stages are in separate reaction vessels and wherein each reaction stage contains a bed of hydroprocessing catalyst. The liquid product from the first reaction stage is sent to a stripping stage and stripped of $H_2S$, $NH_3$ and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. Each stripping stage is a separate stage, but all stages are contained in the same stripper vessel.

BACKGROUND OF THE INVENTION

As supplies of lighter and cleaner feedstocks dwindle, the petroleum industry will need to rely more heavily on relatively high boiling feedstocks derived from such materials as coal, tar sands, oil-shale, and heavy crudes. Such feedstocks generally contain significantly more undesirable components, especially from an environmental point of view. Such undesirable components include halides, metals and heteroatoms such as sulfur, nitrogen, and oxygen. Furthermore, specifications for fuels, lubricants, and chemical products, with respect to such undesirable components, are continually becoming tighter. Consequently, such feedstocks and product streams require more severe upgrading in order to reduce the content of such undesirable components. More severe upgrading, of course, adds considerably to the expense of processing these petroleum streams.

Hydroprocessing, which includes hydroconversion, hydrocracking, hydrotreating, and hydroisomerization, plays an important role in upgrading petroleum streams to meet the more stringent quality requirements. For example, there is an increasing demand for improved heteroatom removal, aromatic saturation, and boiling point reduction. Much work is presently being done in hydrotreating because of greater demands for the removal of heteroatoms, most notably sulfur, from transportation and heating fuel streams. Hydrotreating, or in the case of sulfur removal, hydrodesulfurization, is well known in the art and usually requires treating the petroleum streams with hydrogen in the presence of a supported catalyst at hydrotreating conditions. The catalyst is typically comprised of a Group VI metal with one or more Group VIII metals as promoters on a refractory support. Hydrotreating catalysts which are particularly suitable for hydrodesulfurization and hydrodenitrogenation generally contain molybdenum or tungsten on alumina promoted with a metal such as cobalt, nickel, iron, or a combination thereof. Cobalt promoted molybdennm on alumina catalysts are most widely used for hydrodesulfurization, while nickel promoted molybdenum on alumina catalysts are the most widely used for hydrodenitrogenation and aromatic saturation.

Much work is being done to develop more active catalysts and improved reaction vessel designs in order to meet the demand for more effective hydroprocessing processes. Various improved hardware configurations have been suggested. One such configuration is a countercurrent design wherein the feedstock flows downward through successive catalyst beds counter to upflowing treat gas, which is typically a hydrogen containing treat-gas. The downstream catalyst beds, relative to the flow of feed can contain high performance, but otherwise more sulfur sensitive catalysts because the upflowing treat gas carries away heteroatom components such as $H_2S$ and $NH_3$ that are deleterious to the sulfur and nitrogen sensitive catalysts. While such countercurrent reactors have commercial potential, they never-theless are susceptible to flooding. That is, where upflowing treat gas and gaseous products impede the downward flow of feed.

Other process configurations include the use of multiple reaction stages, either in a single reaction vessel, or in separate reaction vessels. More sulfur sensitive catalysts can be used in downstream stages as the level of heteroatom components becomes successively lower. European Patent Application 93200165.4 teaches a two-stage hydrotreating process performed in a single reaction vessel, but there is no suggestion of a unique stripping arrangement for the liquid reaction stream from each reaction stage.

While there is a substantial amount of art relating to hydroprocessing catalysts, as well as process designs, there still remains a need in the art for process designs that offer further improvement.

SUMMARY OF THE INVENTION

In accordance with the present invention, there is provided a process for hydroprocessing a hydrocarbonaceous feedstock, in the presence of a hydrogen-containing treat gas, in two or more reaction stages, each containing a hydroprocessing catalyst, wherein the reaction stage which is first with respect to the flow of feedstock is last with respect to the flow of treat gas, and wherein each successive downstream reaction stage with respect to the flow of feedstock is the next upstream stage with respect to the flow of treat gas, and wherein both feedstock and a treat gas flow co-currently in each reaction stage, and wherein the liquid product from each reaction stage is stripped of dissolved gases in it's own stripping stage, and wherein more than one stripping stage is contained in a single stripping vessel;

which process comprises:

(a) reacting said hydrocarbonaceous feedstock in a first reaction stage in the presence of a treat gas comprised of once-through hydrogen-containing treat gas and recycle treat gas from a downstream reaction stage, wherein said reaction stage contains a hydroprocessing catalyst and is operated at hydroprocessing conditions thereby producing a reaction product comprised of a liquid component and a vapor component;

(b) separating the liquid component from said vapor component;

(c) stripping said liquid component of dissolved gaseous material in a stripping stage only for that liquid component;

(d) reacting said stripped liquid component of step (c) in the next downstream reaction stage with respect to the flow of feedstock, which reaction stage contains a hydroprocessing catalyst and is operated at hydroprocessing conditions, thereby resulting in a reaction product comprised of a liquid component and a vapor component;

(e) separating said liquid component from said vapor component;

(f) stripping said liquid component of dissolved gaseous material in a stripping stage only for that liquid component;

(g) repeating steps (d), (e), and (f) until the liquid stream is treated in the last downstream reaction stage with respect to the flow of feedstock.

In a preferred embodiment of the present invention the dissolved gaseous material contains $H_2S$ and $NH_3$.

DETAILED DESCRIPTION OF THE INVENTION

Non-limiting examples of hydroprocessing processes which can be practiced by the present invention include the hydroconversion of heavy petroleum feedstocks to lower boiling products; the hydrocracking of distillate, and higher boiling range feedstocks; the hydrotreating of various petroleum feedstocks to remove heteroatoms, such as sulfur, nitrogen, and oxygen; the hydrogenation of aromatics; the hydroisomerization and/or catalytic dewaxing of waxes, particularly Fischer-Tropsch waxes; and the demetallation of heavy streams. Ring-opening, particularly of naphthenic rings, can also be considered a hydroprocessing process.

Figure 1:
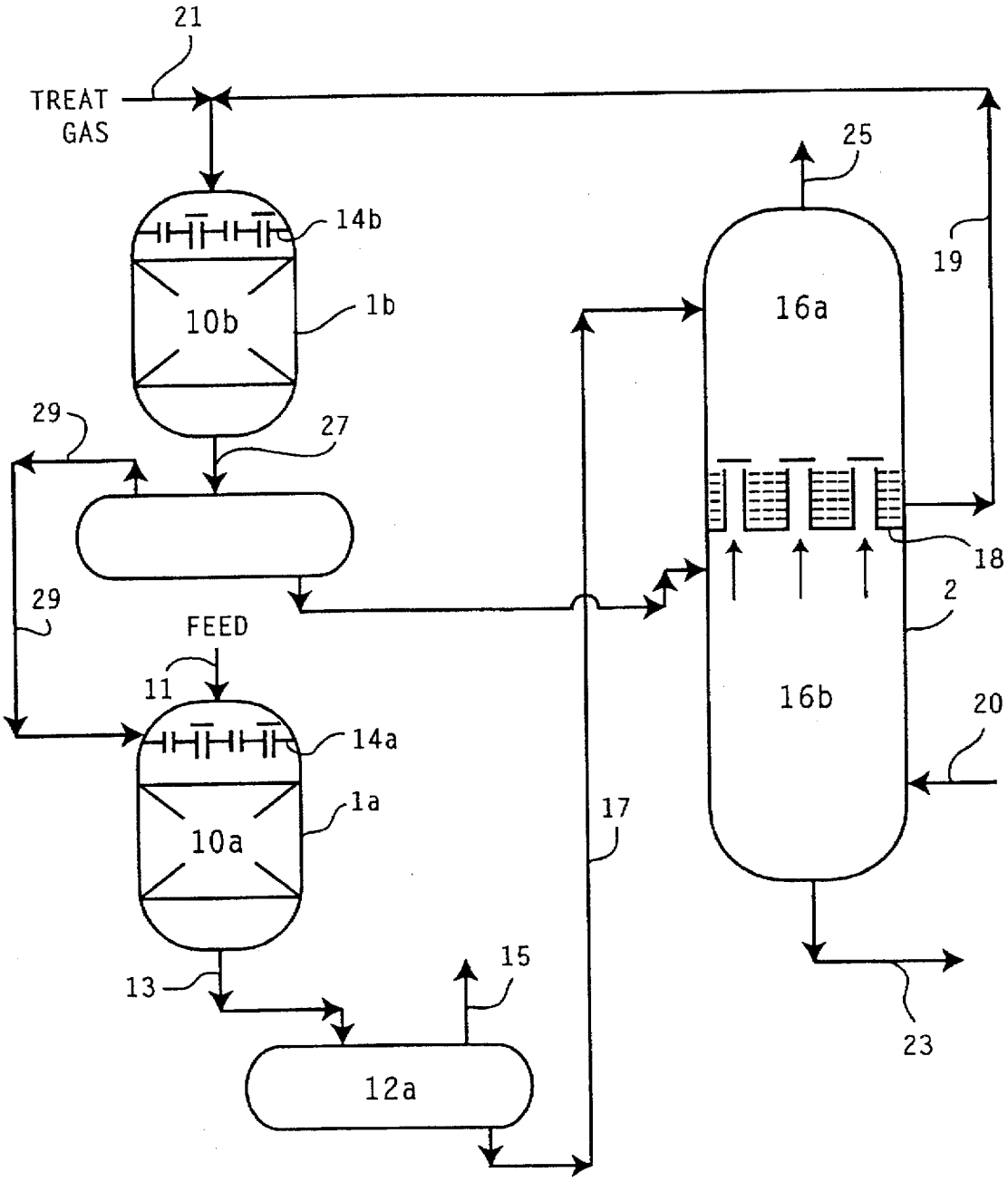
FIG. 1 hereof shows multiple reaction vessels of the present invention showing two reaction stages and a stripping vessel having two stripping stages.

The process of the present invention can be better understood by a description of a preferred embodiment illustrated by FIG. 1 hereof. For purposes of discussion, the reaction stages will be assumed to be hydrotreating stages, although they can just as well be any of the other aforementioned types of hydroprocessing stages. Miscellaneous reaction vessel internals, valves, pumps, thermocouples, and heat transfer devices etc. are not shown in either figures for simplicity. FIG. 1 shows reaction vessel 1*a* which contains reaction stage 10*a*, which is comprised of hydroprocessing catalyst. Downstream of each reaction stage is a gas/liquid separation means 12*a* and 12*b*. There is also provided a flow distributor means 14*a* and 14*b* upstream of each reaction stage. Stripping vessel 2 contains two stripping stages 16*a* and 16*b* and gas/liquid separator means 18. The stripping stages need not be in a single vessel. Separate vessels can be used for each stripping stage as long as each stripping stage is distinct for the liquid reaction product from any particular reaction stage. That is, each reaction stage is associated with its own, or discrete stripping stage. The stripping vessel is operated in countercurrent mode wherein upflowing stripping gas, preferably steam, is introduced into the stripping vessel via line 20 and passes upwardly through both stripping stages as liquid reaction product flows downwardly through the respective stripping stage. The counter flowing stripping gas aids in stripping the downflowing liquid of dissolved gaseous impurities, such as $H_2S$ and $NH_3$, which are considered undesirable in most fuel products. It is preferred that the stripping stages contain a suitable stripping median that will enhance the stripping capacity of the stripping stage. Preferred stripping medians are those with high enough surface area to enhance the separation of dissolved gases from liquids. Non-limiting examples of suitable stripping medians include trays as well as packed beds of materials such as conventional structured packings well known to those having ordinary skill in the hydroprocessing art.

The process of the present invention is practiced, with respect to FIG. 1, by feeding the hydrocarbonaceous feedstock above the bed of catalyst of reaction stage 10*a* via line 11. It is preferred that the catalyst be in the reactor as a fixed bed, although other types of catalyst arrangements can be used, such as slurry or ebullating beds. The feedstock enters the reaction vessel and is distributed, with a treat gas, along the top of the catalyst bed of reaction stage 10*a* by distributor means 14*a* where it then passes through the bed of hydroprocessing catalyst and undergoes the intended reaction. The type of liquid distribution means is believed not to limit the practice of the present invention, but a tray arrangement is preferred, such as sieve trays, bubble cap trays, or trays with spray nozzles, chimneys, tubes, etc.

Reaction products and downflowing treat gas exit the reaction vessel via line 13 to gas/liquid separator 12*a* where a vapor phase effluent fraction is drawn off via line 15. The vapor phase effluent fraction can be collected, but it is preferred that at least a portion of it be passed to reaction stage 10*b*. The vapor phase stream is preferably scrubbed to remove contaminants such as $H_2S$ and $NH_3$, and compressed (not shown) prior to recycle. The liquid reaction product is fed to stripping stage 16*a* via line 17 where it comes into contact with upflowing stripping gas, preferably steam. It is preferred that the stripping stage contain packing, or trays, as previously mentioned, to provide increased surface area for contacting between the liquid and the stripping gas. Stripped liquid collects in the gas/liquid separator means 18 and is drawn off via line 19 and fed, with a suitable hydrogen-containing treat gas via line 21, into reaction vessel 1*b* to reaction stage 10*b* where it is passed through distributor means 14*b*. The feedstream, at this point, contains substantially less undesirable species, such as sulfur and nitrogen species. Both downflowing treat gas and downflowing stripped liquid from the first reaction stage pass through the bed of catalyst in reaction stage $\mathbf{10}_b$ where the stripped liquid reaction product undergoes the intended reaction. The catalyst in this catalyst bed may be the same or different than the catalyst in the first reaction stage. The catalyst in this second reaction stage can be a high performance catalyst which otherwise can be more sensitive to heteroatom poisoning because of the lower level of heteroatoms in the treated feedstream, as well as low levels of heteroatom species $H_2S$ and $NH_3$ in the treat gas. Liquid and vapor reaction product from second reaction stage $\mathbf{10}_b$ is passed via line 27 to gas/liquid separator means $\mathbf{12}_b$ where the liquid fraction is passed to second stripping stage $\mathbf{16}_b$ where it flows downward and countercurrent to upflowing stripping gas. Stripped liquid from stripping stage $\mathbf{16}_b$ exits the stripping vessel via line 23. The gaseous components that are stripped from the liquid reaction product from both stripping stages exit the stripping vessel via line 25. A portion of the vapor effluent exiling line 25 can also be condensed and returned to the stripping vessel (not shown). The vapor product fraction from second reaction stage 10*b* is passed via line 29 to first reaction stage 10*a*.

There may be situations when somewhat higher levels of heteroatoms can be tolerated in downstream reaction stages. For example, the catalyst in the downstream reaction stage may be relatively tolerant to relatively small amounts of heteroatom species $H_2S$ and $NH_3$ in the feedstream to be treated in that reaction stage. In such cases, it may be desirable to use separators, or flash drums, in place of strippers wherein the product stream is flashed and a vapor fraction drawn off overhead and the liquid fraction collected below. The liquid fraction will contain somewhat higher levels of $H_2S$ and $NH_3$ than if the fraction was derived from a stripper. It is within the scope of this invention to use multiple separation steps or devices instead of a single stripping stage.

As previously mentioned, the reaction stages can contain any combination of catalyst depending on the feedstock and the intended final product. For example, it may be desirable to remove as much of the heteroatoms from the feedstock as possible. In such a case, both reaction stages will contain a hydrotreating catalyst. The catalyst in the downstream reaction stage can be more heteroatom sensitive because the liquid stream entering that stage will contain lower amounts of heteroatoms than the original feedstream and reaction inhibitors, such as $H_2S$ and $NH_3$, have been reduced. When the present invention is used for hydrotreating to remove substantially all of the heteroatoms from the feedstream, it is preferred that the first reaction stage contain a Co-Mo on a refractory support catalyst and a downstream reaction stage contain a Ni-Mo on a refractory support catalyst.

The term "hydrotreating" as used herein refers to processes wherein a hydrogen-containing treat gas is used in the presence of a suitable catalyst which is primarily active for the removal of heteroatoms, such as sulfur, and nitrogen, and for some hydrogenation of aromatics. Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Co; and at least one Group VI metal, preferably Mo and W, more preferably Mo, on a high surface area support material, preferably alma. Other suitable hydrotreating catalysts include zeolitic catalysts, as well as noble metal catalysts where the noble metal is selected from Pd and Pt. It is within the scope of the present invention that more than one type of hydrotreating catalyst be used in the same reaction vessel. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydrotreating temperatures range from about 100° C. to about 400° C. with pressures from about 50 psig to about 3,000 psig, preferably from about 50 psig to about 2,500 psig. If the feedstock contains relatively low levels of heteroatoms, then the hydrotreating step may be eliminated and the feedstock passed directly to an aromatic saturation, hydrocracking, and/or ring-opening reaction stage.

Figure 2:
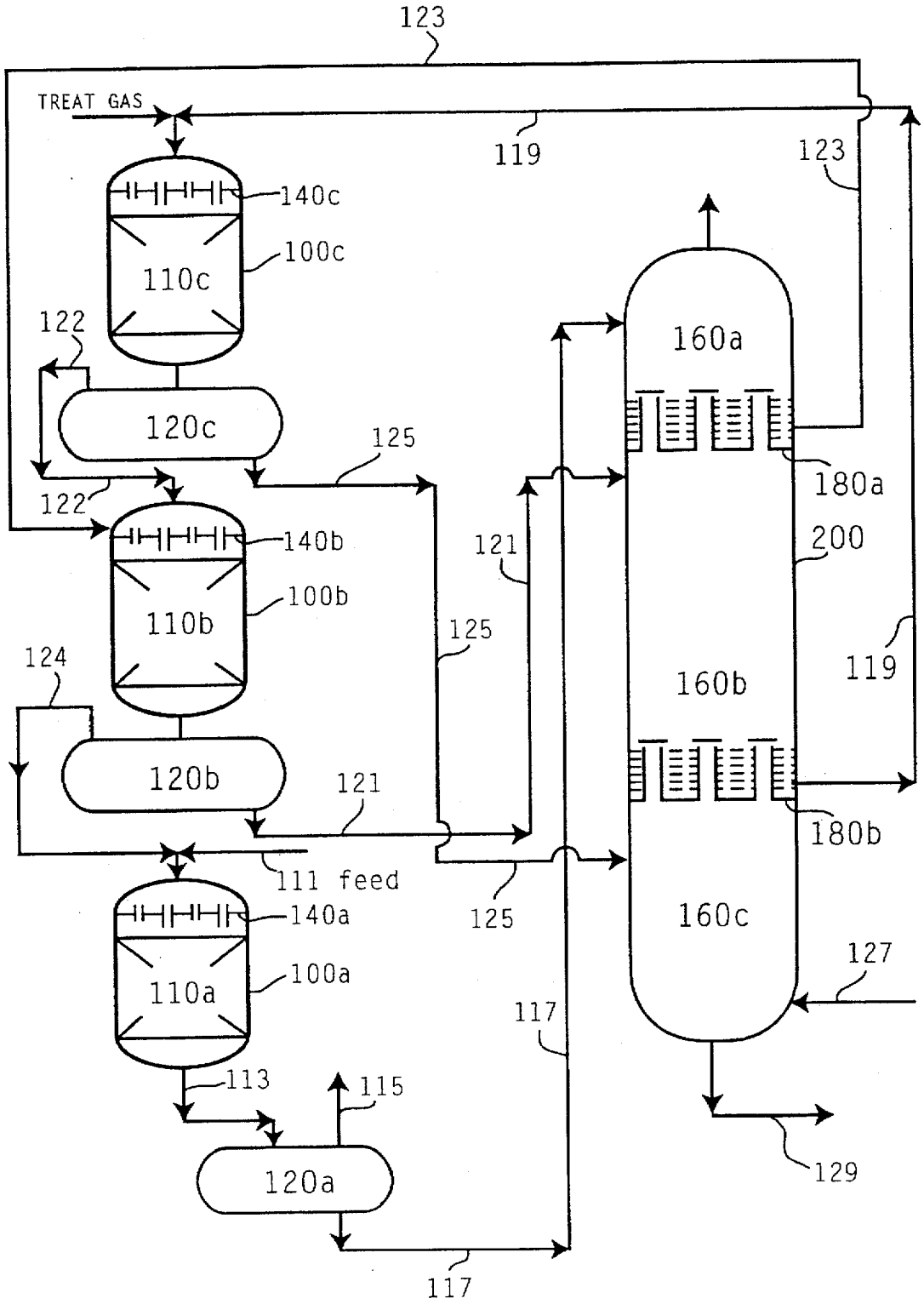
FIG. 2 hereof shows reaction vessels of the present invention showing three reaction stages and a stripping vessel having three stripping stages.

FIG. 2 hereof shows a multi-stage hydroprocessing process of the present invention containing three reaction stages. It is to be understood that any number of reaction stages can be used as long as the general process scheme of the present invention is followed wherein the first reaction stage, with respect to the flow of feedstock, is the last reaction stage with respect to the flow of treat gas. It is within the scope of the invention that any of the reaction stages have more than one catalyst bed. Also, treat gas can be introduced at any reaction stage. That is, it need not only be introduced into the last stage relative to the flow of liquid. Additional treat gas can also be introduced at each reaction stage. It is preferred that each successive upstream stage, with respect to treat gas, is the next successive downstream stage with respect to feedstock. The reaction vessel 100*a* of FIG. 2 hereof shows reaction stage 110*a*, reaction vessel 100*b* shows reaction stage 110*b*, and reaction vessel 100*c* shows reaction stage 110*c*. Downstream of each reaction stage is a gas/liquid separation means 120*a*, 120*b*, and 120*c*. There is also provided a flow distributor means 140*a*, 140*b*, and 140*c* upstream of each reaction stage. Stripping vessel 200 contains three stripping stages 160*a*, 160*b*, and 160*c* and gas/liquid separator means 180*a*, and 180*b*. The stripping vessel is operated in countercurrent mode wherein upflowing stripping gas, preferably steam, passes through the stripping stages. The stripping stages preferably contain a stripping median, such as contacting trays, or packing, to facilitate mass transfer between the downward flowing liquid and the upward flowing stripping gas. The stripping median and material are the same as described for FIG. 1 hereof.

The process of the present invention is practiced, in relation to the three stage reaction vessel of FIG. 2 by feeding the feedstock above the bed of catalyst of the first reaction stage 110*a* via line 111. Treat gas from separator means 120*b* is also passed to reaction stage 110*a* via line 124. The feedstock enters the reaction vessel and is distributed above the catalyst bed through distributor means 140*a* and passes through the bed where it undergoes the intended reaction. Reaction products and downflowing treat gas exit the reaction vessel via line 113 to gas/liquid separator 120*a* where the gas is drawn off via line 115 and which can be sent for recycle to any reaction stage. The gaseous stream is preferably scrubbed to remove impurities such as $H_2S$, $NH_3$, etc., and compressed (not shown) prior to recycle. The liquid reaction product is fed to stripping stage 160*a* via line 117 where dissolved gaseous components, including $H_2S$ and $NH_3$ are stripped.

Stripped liquid collects in the gas/liquid separator means 180*a* and is drawn off via line 123 and fed into reaction vessel 100*b* upstream of reaction stage 110*b* and upstream of flow distributor means 140*b*. Both downflowing treat gas from separator means 120*c* via line 122 and downflowing stripped liquid reaction product pass through the bed of catalyst in reaction stage 110*b*. Liquid reaction product from second reaction stage 110*b* is separated via gas/liquid separator means 120*b* and passed to second stripping stage 160$_b$ via line 121 where it flows downward through the stripping stage and countercurrent to upflowing stripping gas which is introduced into stripping vessel 200 via line 127. Stripped liquid from stripping stage 160*b* is separated via gas/liquid separator 180*b* and passed to the third reaction stage 110*c* via line 119 where it enters the reaction vessel 100*c* upstream of flow distributor means 140*c* and through the bed of catalyst in said third reaction stage 110*c*. Liquid reactant is separated via gas/liquid separator means 120*c* and passed to stripping stage 160*c* via line 125, which like the other two stripping stages, preferably contains a bed of stripping material, or suitable trays, and where the liquid reactant flows countercurrent to upflowing steam. Clean stripped liquid product is drawn from the stripping vessel via line 129. The gaseous components that are stripped from the reaction products exit the stripping vessel via line 131, a portion of which can be condensed and recycled to the stripping vessel (not shown). As mentioned earlier, any other suitable stripping gas can also be used besides stem. Further, all of the stripping gas need not be introduced at the bottom of the stripping vessel, but portions can be added in any of the stripping stages.

The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig.

Feedstocks suitable for use in such systems include those ranging from the naphtha boiling range to heavy feedstocks, such as gas oils and resids. Typically, the boiling range will be from about 40° C. to about 1000° C. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), and light cat cycle oil (LCCO).

For purposes of hydroprocessing, the term "hydrogen-containing treat gas" means a treat gas stream containing at least an effective amount of hydrogen for the intended reaction. The treat gas stream introduced to the reaction vessel will preferably contain at least about 50 vol. %, more preferably at least about 75 vol. % hydrogen. It is preferred that the hydrogen-containing treat gas be make-up hydrogen-rich gas, preferably hydrogen.

Depending on the nature of the feedstock and the desired level of upgrading, more than two reaction stages may be preferred. For example, when the desired product is a distillate fuel, it is preferred that it contain reduced levels of sulfur and nitrogen. Further, distillates containing paraffins, especially linear paraffins, are often preferred over naphthenes, which are often preferred over aromatics. To achieve this, at least one downstream catalyst will be selected from the group consisting hydrotreating catalysts, hydrocracking catalysts, aromatic saturation catalysts, and ring-opening catalysts. If it is economically feasible to produce a product stream with high levels of paraffins, then the downstream reaction stages will preferably include an aromatic saturation stage and a ring-opening stage.

If one of the downstream reaction stages is a hydrocracking stage, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. The zeolite cracking bases are sometimes referred to in the art as molecular sieves, and are generally composed of silica, alumina, and one or more exchangeable cations such as sodium, magnesium, calcium, rare earth metals, etc. They are further characterized by crystal pores of relatively uniform diameter between about 4 and 12 Angstroms. It is preferred to use zeolites having a relatively high silica/alumina mole ratio greater than about 3, preferably greater than about 6. Suitable zeolites found in nature include mordenite, clinoptiliolite, ferrierite, dachiardite, chabazite, erionite, and faujasite. Suitable synthetic zeolites include the Beta, X, Y, and L crystal types, e.g., synthetic faujasite, mordenite, ZSM-5, MCM-22 and the larger pore varieties of the ZSM and MCM series. A particularly preferred zeolite is any member of the faujasite family, see Tracy et al. Proc. of the Royal Soc., 1996, Vol. 452, p813. It is to be understood that these zeolites may include demetallated zeolites which are understood to include significant pore volume in the mesopore range, i.e., 20 to 500 Angstroms. Non-limiting examples of Group VIII metals which may be used on the hydrocracking catalysts include iron, cobalt, nickel, ruthenium, rhodium, palladium, osmium, iridium, and platinum. Preferred are platinum and palladium, with platinum being more preferred. The amount of Group VIII metal will range from about 0.05 wt. % to 30 wt. %, based on the total weight of the catalyst. If the metal is a Group VIII noble metal, it is preferred to use about 0.05 to about 2 wt. %. Hydrocracking conditions include temperatures from about 200° to 425° C., preferably from about 220° to 330° C., more preferably from about 245° to 3 15° C.; pressure of about 200 psig to about 3,000 psig; and liquid hourly space velocity from about 0.5 to 10 V/V/Hr, preferably from about 1 to 5 V/V/Hr.

Non-limiting examples of aromatic hydrogenation catalysts include nickel, cobalt-molybdenum, nickel-molybdenum, and nickel-tungsten. Noble metal containing catalysts can also be used. Non-limiting examples of noble metal catalysts include those based on platinum and/or palladium, which is preferably supported on a suitable support material, typically a refractory oxide material such as alumina, silica, alumina-silica, kieselguhr, diatomaceous earth, magnesia, and zirconia. Zeolitic supports can also be used. Such catalysts are typically susceptible to sulfur and nitrogen poisoning. The aromatic saturation stage is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

The liquid phase in the reaction vessels used in the present invention will typically be the higher boiling point components of the feed. The vapor phase will typically be a mixture of hydrogen-containing treat gas, heteroatom impurities like $H_2S$ and $NH_3$, and vaporized lower-boiling components in the fresh feed, as well as light products of hydroprocessing reactions. If the vapor phase effluent still requires further hydroprocessing, it can be passed to a vapor phase reaction stage containing additional hydroprocessing catalyst and subjected to suitable hydroprocessing conditions for further reaction. It is also within the scope of the present invention that a feedstock which already contains adequately low levels of heteroatoms be fed directly into the reaction stage for aromatic saturation and/or cracking. If a preprocessing step is performed to reduce the level of heteroatoms, the vapor and liquid can be disengaged and the liquid effluent directed to the appropriate reaction stage. The vapor from the preprocessing step can be processed separately or combined with the vapor phase product from the reaction vessel of the present invention. The vapor phase product(s) may undergo further vapor phase hydroprocessing if greater reduction in heteroatom and aromatic species is desired or sent directly to a recovery system.

What is claimed is:

1. A process for hydroprocessing a hydrocarbonaceous feedstock, in the presence of a hydrogen-containing treat gas, in two or more reaction stages, each containing a hydroprocessing catalyst, wherein the reaction stage which is first with respect to the flow of feedstock is last with respect to the flow of treat gas, and wherein each successive downstream reaction stage with respect to the flow of feedstock is the next upstream stage with respect to the flow of treat gas, and wherein both feedstock and a treat gas flow co-currently in each reaction stage, and wherein the liquid product from each reaction stage is stripped of dissolved gases in it's own stripping stage, and wherein more than one stripping stage is contained in a single stripping vessel;

which process comprises:

(a) reacting said hydrocarbonaceous feedstock in a first reaction stage in the presence of a treat gas comprised of once-through hydrogen-containing treat gas and recycle treat gas from a downstream reaction stage, wherein said reaction stage contains a hydroprocessing catalyst and is operated at hydroprocessing conditions thereby producing a reaction product comprised of a liquid component and a vapor component;

(b) separating the liquid component from said vapor component;

(c) stripping said liquid component of dissolved gaseous material in a stripping stage only for that liquid component;

(d) reacting said stripped liquid component of step (c) in the next downstream reaction stage with respect to the flow of feedstock, which reaction stage contains a hydroprocessing catalyst and is operated at hydroprocessing conditions, thereby resulting in a reaction product comprised of a liquid component and a vapor component;

(e) separating said liquid component from said vapor component;

(f) stripping said liquid component of dissolved gaseous material in a stripping stage only for that liquid component;

(g) repeating steps (d), (e), and (f) until the liquid stream is treated in the last downstream reaction stage with respect to the flow of feedstock.

2. The process of claim 1 wherein at least the first reaction stage with respect to the flow of feedstock contains hydrotreating catalyst for the removal of heteroatoms from the feedstream and is operated under hydrotreating conditions including temperatures ranging from about 100° C. to about 400° C. at pressures from about 50 psig to about 3,000 psig.

3. The process of claim 2 wherein all of the reaction stages contain hydrotreating catalyst for the removal of heteroatoms from the feedstream and are operated under hydrotreating conditions including temperatures ranging from about 100° C. to about 400° C. at pressures from about 50 psig to about 3,000 psig.

4. The process of claim 2 wherein the hydrotreating catalyst is comprised of at least one metal from Group VIII and at least one metal from Group VI of the Periodic Table of the Elements, said metals on an inorganic refractory support.

5. The process of claim 4 wherein the Group VIII metal is selected from the group consisting of a noble metal, Fe, Co and Ni, and the Group VI metal is selected from Mo and W.

6. The process of claim 5 wherein at least the first reaction stage contains a catalyst comprised of Co and Mo on a suitable support, and at least one downstream reaction stage contains a catalyst comprised of Ni and Mo on a suitable support.

7. The process of claim 5 wherein the noble metal is selected from Pt and Pd.

8. The process of claim 1 wherein at least one of the downstream reaction stages with respect to the flow of feedstock contains hydrocracking catalyst and is operated under hydrocracking conditions including temperatures from about 200° to 425° C. and liquid hourly space velocity from about 0.5 to 10 V/V/Hr.

9. The process of claim 8 wherein the hydrocracking catalyst is comprised of a Group VIII metal on a zeolitic support, which Group VIII metal is selected from the group consisting of iron, cobalt, nickel, ruthenium, rhodium, palladium, osmium, iridium, and platinum; and wherein the zeolitic material is a zeolite having crystal pores of relatively uniform diameter between about 4 and 12 Angstroms and a silica/alumina mole ratio greater than about 3.

10. The process of claim 9 wherein the amount of Group VIII metal is from about 0.05 wt. % to 30 wt. %, based on the total weight of the catalyst, and the zeolite is selected from the group consisting of mordenite, clinoptiliolite, ferrierite, dachiardite, chabazite, erionite, and faujasites.

11. The process of claim 1 wherein at least one of the downstream reaction stages with respect to the flow of feedstock contains hydrogenation catalyst for the hydrogenation of aromatics and is operated at hydrogenation conditions which include temperatures from about 40° C. to about 400° C., and pressures from about 100 to 3,000 psig.

12. The process of claim 11 wherein the aromatic hydrogenation catalyst is comprised of nickel or a noble metal selected from Pt and Pd on an inorganic refractory support.

13. The process if claim 1 wherein three reaction stages are present, the first reaction stage being the hydrotreating reaction stage, the second reaction stage being a hydrocracking stage, and wherein the third reaction stage is an aromatic saturation stage.

14. The process of claim 1 wherein at least one of the stripping stages contains a stripping median that enhances the removal of $H_2S$, $NH_3$ and other dissolved gases from a liquid.

15. The process of claim 1 wherein there are two reaction stages the first of which is a hydrotreating stage for the removal of heteroatoms and the second stage is a hydrocracking stage for converting the feedstream to lower boiling products.

16. The process of claim 1 wherein a portion of the liquid reaction product from at least one reaction stage is passed the next downstream reaction stage without being stripped of dissolved gaseous material.

* * * * *